United States Patent [19]

Kuritsky et al.

[11] Patent Number: 4,993,204

[45] Date of Patent: Feb. 19, 1991

[54] COMPOSITE METAL AND PLASTIC FRAME STRUCTURE FOR WINDOWS AND DOORS

[75] Inventors: Harold Kuritsky, Lido Beach, N.Y.; Brendan J. O'Connor, West Milford, N.J.

[73] Assignees: Robert T. Feury, Kearny; Herbert Smilowitz, West Orange, both of N.J.

[21] Appl. No.: 493,911

[22] Filed: Mar. 15, 1990

[51] Int. Cl.[5] ..... E04C 1/00; E04C 3/30; E06B 1/04

[52] U.S. Cl. ..... 52/309.15; 52/727; 49/504; 49/DIG. 1

[58] Field of Search ..... 52/656, 727, 731, 309.15, 52/309.16; 49/504, 505, DIG. 1, DIG. 2

[56] References Cited

U.S. PATENT DOCUMENTS

| | | | |
|---|---|---|---|
| 3,530,618 | 9/1970 | Grossman . | |
| 3,703,063 | 11/1972 | Budich et al. | 52/727 |
| 3,868,789 | 3/1975 | Gates . | |
| 3,918,231 | 11/1975 | Kessler . | |
| 3,964,231 | 6/1976 | Budich et al. . | |
| 4,130,976 | 12/1978 | Kesseler et al. . | |
| 4,205,486 | 6/1980 | Guarnacci | 49/504 |
| 4,227,346 | 10/1980 | Kubik . | |
| 4,240,235 | 12/1980 | Nawa . | |
| 4,428,156 | 1/1984 | Malm et al. . | |
| 4,513,552 | 4/1985 | Breithaupt | 49/DIG. 1 |
| 4,624,091 | 11/1986 | Biro | 52/731 |
| 4,640,078 | 2/1987 | Haffer . | |
| 4,689,933 | 9/1987 | Biro | 52/656 |
| 4,740,405 | 4/1988 | Tanaka et al. . | |
| 4,753,043 | 6/1988 | Bockwinkel . | |

*Primary Examiner*—Neill R. Wilson

*Attorney, Agent, or Firm*—Lerner, David, Littenberg, Krumholz & Mentlik

[57] ABSTRACT

Windows, doors and the like are constructed from a composite frame structure combining both metal and plastic components. The frame structure includes a rigid, integral self-supporting metal frame enclosed by a similar rigid, integral self-supporting plastic frame. The resulting windows and doors have enhanced esthetic appeal while, at the same time, providing a weather-proof structure of enhanced strength.

32 Claims, 4 Drawing Sheets

COMPOSITE METAL AND PLASTIC FRAME STRUCTURE FOR WINDOWS AND DOORS

BACKGROUND OF THE INVENTION

The present invention relates in general to windows, doors and the like, and more particularly, to a composite metal and plastic frame structure suitable for use in the construction of windows and doors which combines the esthetics and weatherability of plastic material with the additional strength of metal.

Over the years glass windows and doors, and in particular storm doors, have been constructed from a variety of materials. Not surprisingly, the early use of wood was found to be undesirable due to the need for constant maintenance resulting from wear and to prevent deterioration from the elements. To this end, modern glass windows and storm doors have been made from a variety of more acceptable materials such as aluminum and plastic. Aluminum doors have been painted or powder coated, while aluminum or plastic skins have been overlaid upon wood doors. In addition, steel was also known to have been used.

Despite this variety of compositions, windows and doors constructed therefrom have been found undesirable in a number of respects such as strength, esthetics, corrosion and rot resistance, ease of maintenance, wearability and the like. In an effort to develop new materials for the construction of the frame structure for windows and doors, there is known the use of the combination of aluminum and plastic material. These composite frame structures were primarily concerned with developing materials which reduce the heat transfer through the frame structure to improve their thermal insulating or weather protection function. A variety of constructions combining aluminum and plastic material for windows and doors became known, for example, U.S. Pat. Nos. 4,640,078, 3,918,231 and 4,753,043. Despite the known use of aluminum and plastic material, the design of windows and doors therefrom has not enhanced the overall durability and esthetics which are required by today's building standards and the consumer. Accordingly, there is an unsolved need for a composite aluminum and plastic frame structure for windows and doors which addresses the needs of the builder and consumer in both durability, esthetic appeal and the like.

SUMMARY OF THE INVENTION

One object of the present invention is to provide a composite metal and plastic frame structure for windows and doors which is weatherproof while esthetically pleasing.

Another object of the present invention is to provide a composite metal and plastic frame structure for windows and doors which facilitates manufacture and installation thereof.

Another object of the present invention is to provide a composite metal and plastic frame structure for windows and doors which has an all plastic exterior and hidden fasteners.

Another object of the present invention is to provide a composite metal and plastic frame structure for windows and doors which facilitates the securing of glass panels thereto using fasteners hidden by the frame structure.

In accordance with one embodiment of the present invention, there is disclosed a composite metal and plastic frame structure for windows and doors constructed of a rigid self-supporting metal inner frame, a rigid self-supporting plastic outer frame having an enclosed hollow interior, the metal inner frame contained within the enclosed hollow interior of the plastic outer frame to provide the frame structure, whereby the exterior of the metal inner frame is completely surrounded by the plastic outer frame.

In accordance with another embodiment of the present invention, there is disclosed a composite metal and plastic frame structure for windows and doors constructed of a metal inner frame, a plastic outer frame having a hollow interior, the plastic outer frame having open ends about the outer periphery thereof and closed ends about the inner periphery thereof, the metal inner frame contained within the hollow interior of the plastic outer frame, and plastic members attached to the open ends of the plastic outer frame to enclose the metal inner frame therein.

In accordance with another embodiment of the present invention, there is disclosed a composite metal and plastic frame structure for windows and doors constructed of a plurality of metal members, less than the plurality of metal members connected to form a portion of a rigid metal inner frame, a plurality of plastic members connected to form a rigid plastic outer frame having a hollow interior, the portion of the rigid metal inner frame contained within the hollow interior of the plastic outer frame, and connecting means for connecting the remainder of the plurality of metal members to the portion of the rigid metal inner frame within the hollow interior of the plastic frame to complete the rigid metal inner frame therein.

BRIEF DESCRIPTION OF THE DRAWINGS

The above description, as well as further objects, features and advantages of the present invention will be more fully understood with reference to the following detailed description of a composite metal and plastic frame structure for windows and doors, when taken in conjunction with the accompanying drawings, wherein.

DETAILED DESCRIPTION

Figure 1:
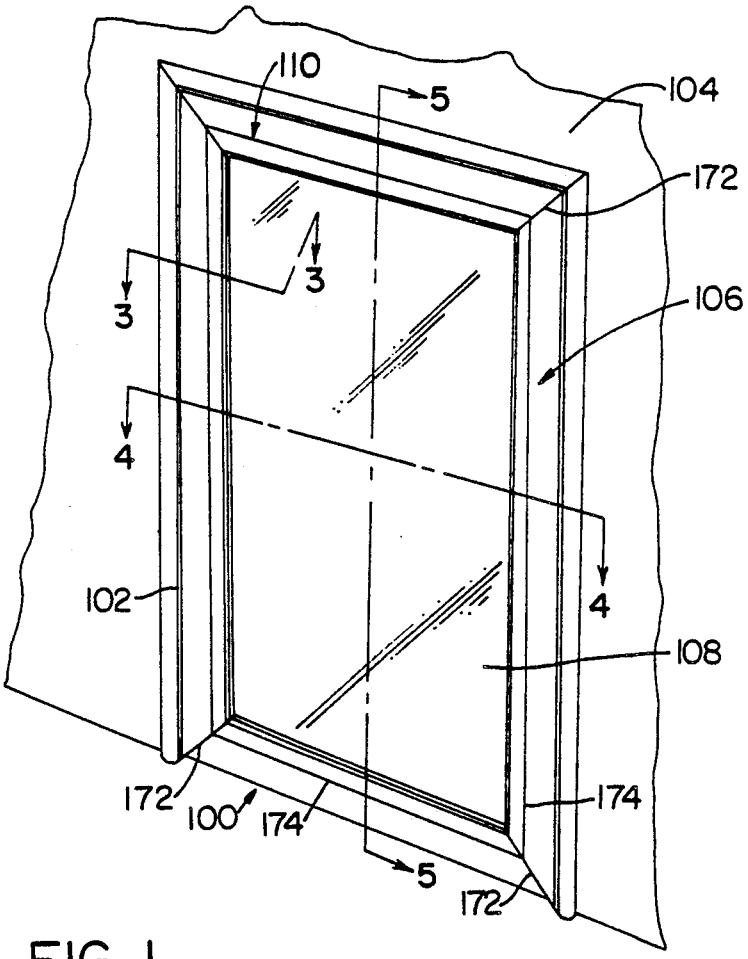
FIG. 1 is a perspective view of a composite metal and plastic frame structure in the nature of a storm door and the like hinged to the casing of a FIG. 2 is a plan view of an assembled rigid metal inner frame having a cut-away portion disclosing the use of internal corner connectors.

Referring now to the drawings wherein like reference numerals represent like elements, there is shown in FIG. 1 a door generally designated by reference numeral 100. The door 100 is particularly suitable for use as a weatherproof storm door by virtue of having one or more glass panes. However, the door 100 may be used for other purposes such as screen doors upon replacement of the glass pane with a screen panel, primary access doors and the like. Although the door 100 has been shown to be hinged to a casing, the door may also be used with appropriate hardware to function as a sliding door. In addition, the composite metal and plastic frame structure to be described is equally suitable for use in the construction of windows and the like. For example, the door 100 illustrated may be secured within an opening of corresponding size and shape to function as a window. The frame structure may also be used in the construction of windows commonly referred to as double hung and tilt type.

As shown in FIG. 1, the door 100 is hinged along one side to a casing 102 defining an opening within wall 104. The door 100 is constructed from a composite metal and plastic frame structure 106 to which there is centrally secured a glass pane 108, such as thermopane and the like. The frame structure 106 itself is constructed generally from two major components, namely, an outer plastic frame 110 which may be extruded from a variety of suitable materials, preferably, polyvinylchloride. Positioned within the hollow interior of the plastic frame 110 is a rigid metal frame 112 (see FIG. 2) which may be constructed from a variety of materials, and preferably, aluminum.

The construction of the door 100 will now be described in detail with respect to FIGS. 2–5. The metal frame 112 is constructed from a plurality of hollow rectangular aluminum members 114 having a pair of spaced apart rails 116 extending from end wall 118 in alignment with side walls 120. The thickness of the walls forming the aluminum member 114 are, for example, in the order of about 10 to 25 mm, and preferably.15 to 20 mm. The individual aluminum members 114 are assembled to form the rigid, self-supporting metal frame 112 by means of internal corner connectors 122 as shown in the lower left-hand portion of FIG. 2. The corner connectors 122 are constructed from a metal, e.g., aluminum, L-shaped hollow bracket extending into the interior of the aluminum members 114 to provide a rigid right angle connection. The aluminum members 114 are secured to the corner connector 122 by means of a plurality of screws 124 extending through the bottom wall 126 of the aluminum members. By virtue of the foregoing construction, the rigid metal frame 112 is integrally constructed to be self-supporting and to function as an independent structural frame separate and apart from the plastic frame 110.

Figure 3:
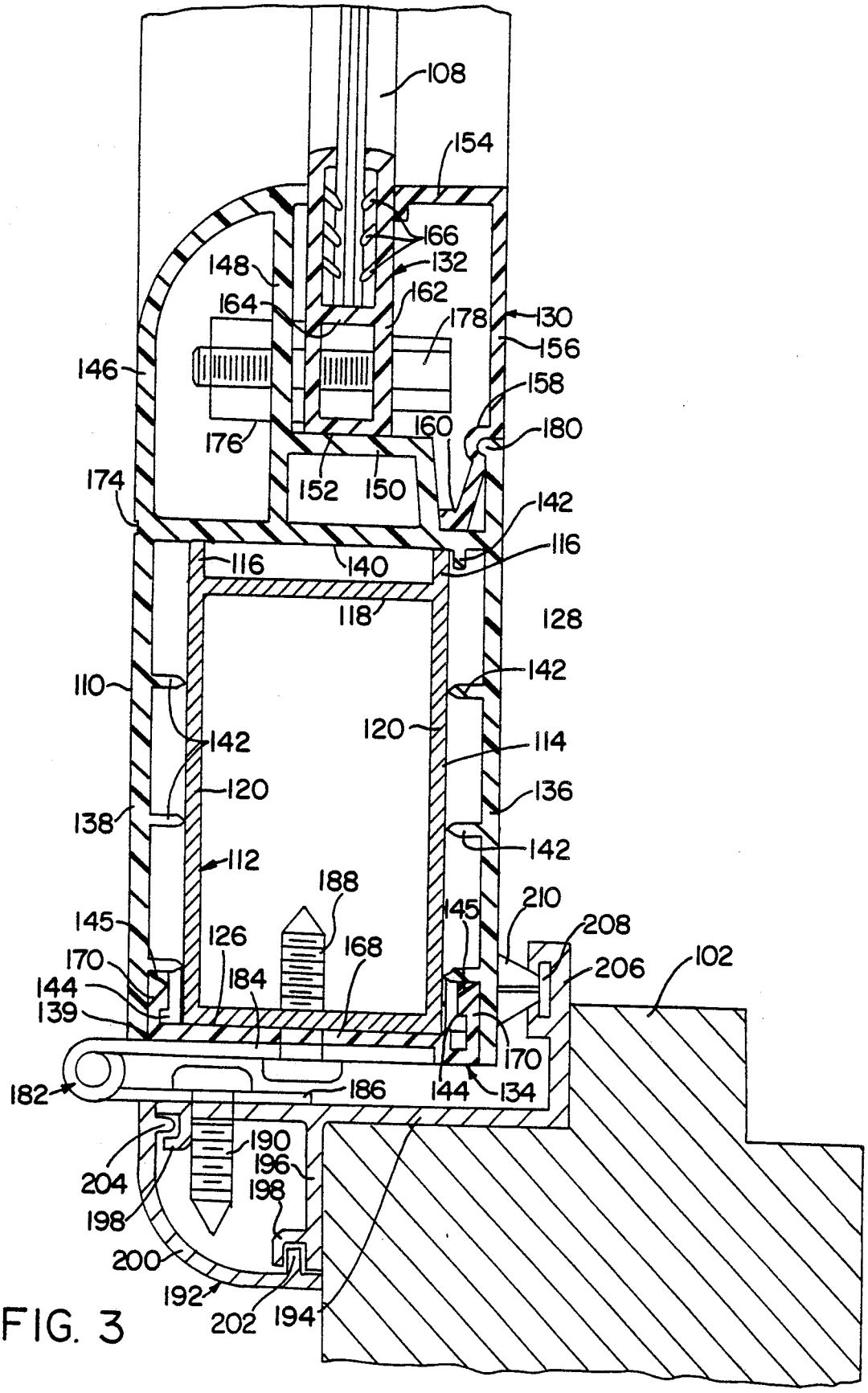
FIG. 3 is a cross-sectional view taken along line 3—3 in FIG. 1 showing the interior construction of the composite metal and plastic frame structure.

Referring now to FIG. 3, the construction of the plastic frame 110 will be described and its cooperation with metal frame 112. The plastic frame 110 is constructed from a hollow main frame member 128, a glazing stop 130, a glazing support 132 and an end band 134. The thickness of the walls forming the plastic frame 110 are, for example, in the order of about 10 to 25 mm, and preferably 15 20 mm. The lower portion of the main frame member 128 includes a pair of spaced apart parallel side walls 136, 138 which extend between an open end 139 and an end closed by means of end wall 140. The interior surfaces of the side walls 136, 138 and end wall 140 are provided with a plurality of inwardly projecting ribs 142. A pair of C-shaped rails 144 are arranged extending inwardly from the inner surfaces of the side walls 136, 138 adjacent the open end 139. The C-shaped rails 144 define an opening 146 facing outwardly towards the open end 139.

The upper portion of the plastic frame 110 includes an outer curved wall 146 supported inwardly by a vertical wall 148 extending to the end wall 140 and an L-shaped member 150 extending between the end wall and vertical wall to form a seat area 152. The components of the plastic frame 110 as thus far described are of unitary construction by being extruded into a continuous length from, for example, polyvinylchloride material.

The glazing stop 130 is generally of L-shape configuration having a short leg 154 and a long leg 156 provided with a half circular portion 158 extending to a depending leg 160. The glazing support 132 is constructed generally from a U-shaped member 162 provided with a central cross-brace 164 and a plurality of spaced apart projections 166 extending inwardly from the inner surface of the upper portion of the U-shaped member. The end band 134 is constructed from a generally flat wall 168 having a pair of spaced apart up-turned ends 170 configured into a latch.

Having thus far described the major components of the door 100, namely, the plastic frame 110 and metal frame 112, the assembly of these components into the completed door will now be described. The plastic frame 110 is constructed from a plurality of main frame members 128 thermalwelded at mitered corners along weld lines 172 as best shown in FIG. 1. The weld lines 172 are recessed to form a groove to match in profile groove 174 provided on the front surface of side wall 138 for esthetic puposes. The incividual main frame members 128 are arranged to have a configuration corresponding to the configuration of the opening desired for the window or door to be constructed therefrom. The plastic frame 110, as thus far constructed, has its open end 139 arranged about the outer periphery to provide access to its hollow interior. This construction provides a plastic frame 110 which is rigid and functions as an independent frame separate and apart from the metal frame 112.

Figure 2:
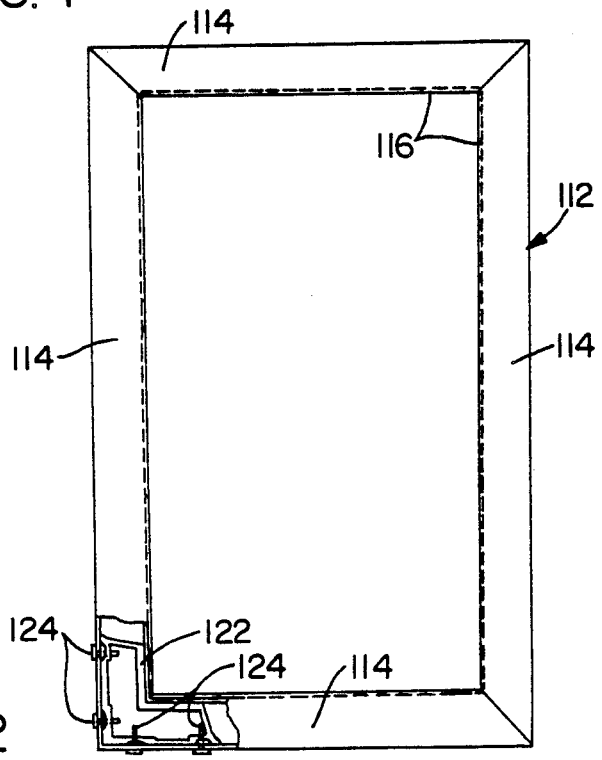
Figure 4:
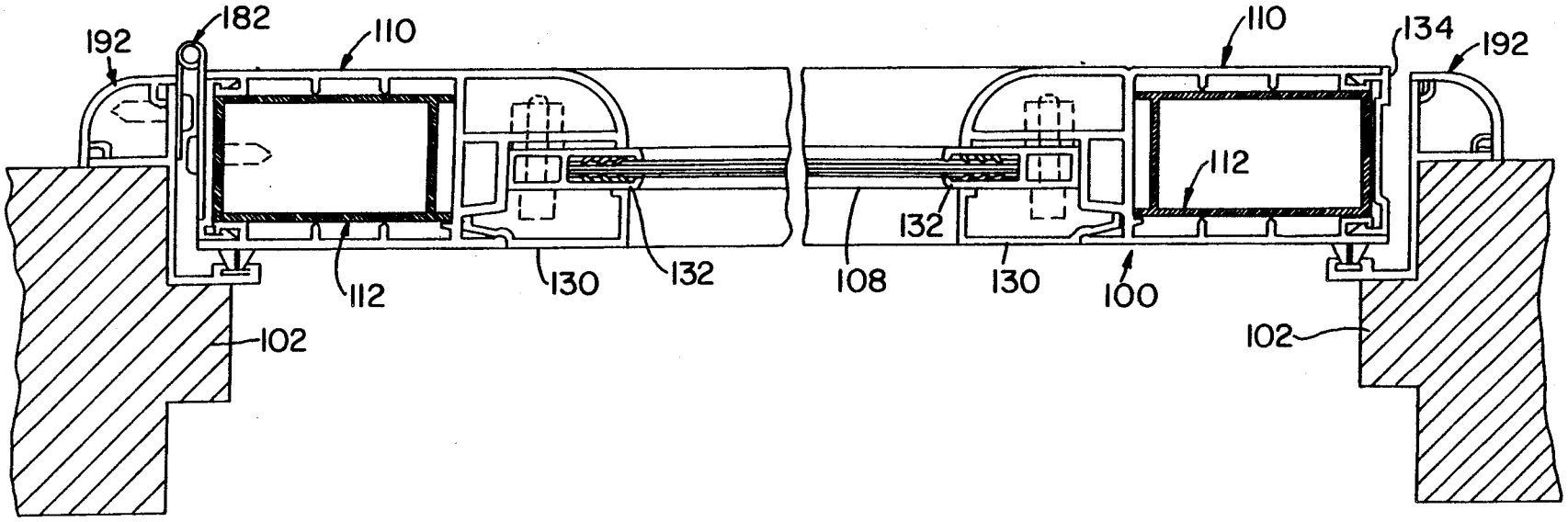
FIG. 4 is a cross-sectional view taken along line 4—4 in FIG. 1 showing the arrangement of the storm door in closed relationship with its supporting casing.

The metal frame 112 is assembled as previously described except for the final connection of one of the aluminum members 114 to provide the metal frame with a U-shape configuration. The corner connectors 122 are secured within the open ends of the remaining unattached aluminum member 114. The incompleted metal frame 112 having a U-shaped configuration is inserted into the hollow interior of the plastic frame 110 through the open ends 139 formed between the side walls 136, 138. For example, as shown in FIGS. 1 and 2, metal frame 112 is assembled into a U-shaped configuration by not securing the short top member to the parallel spaced apart long side members. This portion of the metal frame 112 in the U-shaped configuration is inserted into the plastic frame 110 through the open end 139 of the bottom main frame member 128.

In this regard, the long side members 114 of the metal frame 112 slide upwardly through the hollow interior of the main frame members 128 forming the parallel spaced apart long sides of the plastic frame 110. The metal frame 112 is continuously inserted into the plastic frame 110 until the short end member 114 is received within the bottom main frame member 128. Once fully inserted, the remaining short top member 114 is secured to the long side members 114 of the metal frame 112 by placing same within the hollow interior of the top main frame member 128 and securing by means of the corner connectors 122 via screws 124. As thus far assembled, the rigid self-supporting integral metal frame 112 is contained within the hollow interior of the rigid self-supporting integral plastic frame 110.

The open ends 139 of the main frame members 128 are closed by snapping into place the end bands 134. The end bands 134 are secured by the latch design of the upturned ends 170 releasably engaging the C-shaped rails 144 within openings 145. Once the end bands 134 are secured in place, the plastic frame 110 completely encloses the metal frame 112 such that no portions thereof are exposed. The metal frame 112 is centered within the main frame members 128 by being spaced from the side walls 136, 138 by means of ribs 142 and rails 116 which extends from the end wall 118 of the aluminum members 114. The resulting air gap between the side walls 136, 138 of the main frame member 128 with the metal frame 112, as well as the hollow design of the metal frame itself, greatly reduces thermal conduction between the interior and exterior of the window or door.

The vertical wall 148 of the main frame member 128 is longitudinally provided with a plurality of spaced apart internally threaded rivets 176 secured thereto through corresponding openings. The glazing support 132 is positioned in contact with the seat area 152 opposing vertical wall 148. The lower portion of the glazing support 132 is provided with a plurality of spaced apart openings corresponding to the location of the threaded rivets 176. The glazing support 132 is secured by means of a plurality of bolts 178 threadingly received within the threaded rivets 176. The rivets 176 and protruding ends of bolts 178 are hidden from view by means of the outer curved wall 146. The head end of the bolts 178, in turn, are hidden from view by means of glazing stop 130.

In this regard, the glazing stop 130 is snapped into the position shown by arranging the short leg 154 in contact with the glazing support 132 and half radius portion 158 snapped into place over protrusion 180 formed at the end of an extension from side wall 136. Leg 160 of the glazing stop 130 engages in a resilient compression type fit with the L-shaped member 150 for retaining the glazing stop in releasably secured position for covering the bolts 178, while also adding strength to the glazing support 132. From the foregoing construction, the bolts 178 and rivets 176 are hidden from view to provide a very pleasing esthetic plastic frame 110. The glass pane 108 was previously secured within the opened end of the glazing support 132 by means of projections 166. The door 100 now being completely assembled, is ready for installation.

A metal hinge 182 having a pair of flat blades 184, 186 secures the door 100 to casing 102. Blade 184 is secured to the flat wall 168 of the end band 134 by means of screws 188 which extend through the bottom wall 126 of the metal frame 112. The other blade 186 of the hinge 182 is secured by means of screws 190 to a metal Z-track 192 which itself is secured to the casing 102 by means not shown. The perpendicularly arranged legs 194, 196 of the Z-track 192 support U-shaped projections 198. The opening formed between legs 194, 196, as well as screws 190, is enclosed by means of curved cover plate 200. The cover plate 200 is provided with a pair of inwardly projecting rails 202, 204 which snap into engagement with the U-shaped projections 198 for securing same thereto. The base 206 of the Z-track 192 is provided with a restricted opening 208 for releasably attaching a weather strip 210 which resiliently compresses against the side of the plastic frame 110 when the door is closed. Another Z-track 192, as thus far described with the exception of hinge 182, is secured to the casing 102 facing the opposite side of the door 100.

Figure 5:
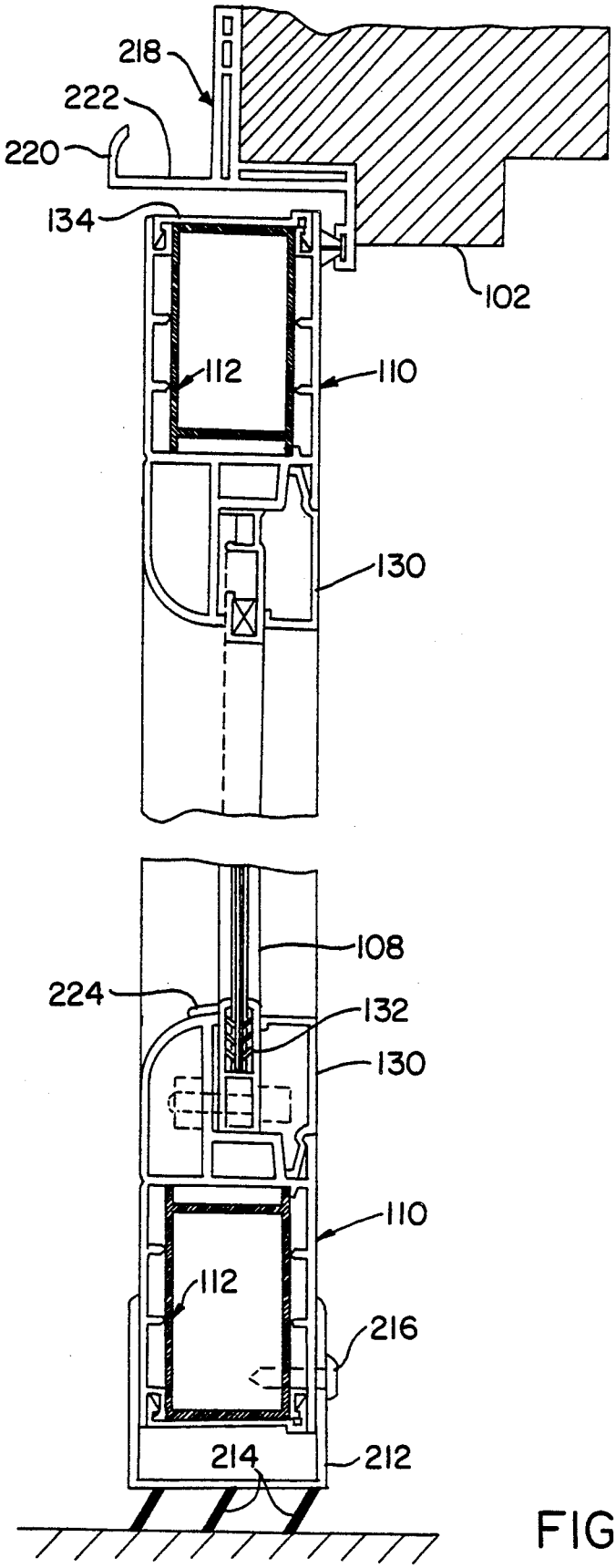
FIG. 5 is a cross-sectional view of the door taken along line 5—5 in FIG. 1 showing its relationship with the floor and overhead casing.

A U-shaped rail sweep 212 having a plurlaity of resilient outwardly extending fingers 214 is secured to the bottom of the frame structure 106 by emans of screws 216. The rail sweep 212 may be adjusted in height such that the fingers 214 frictionally engage the floor surface. The upper casing 102 supports a header 218 having an outwardly extending upturned end 220 which provides a rain catch formed by ledge 222. Concerning condensation or rain, as shown in FIG. 5, the glazing support 132 along the bottom plastic frame 110 is provided with an outwardly extending curved lip 224. The lip 224 prevents rain or condensation running down the outside of the glass pane 108 from flowing into the interior of the plastic frame 110.

The resulting frame structure 106 of the present invention has been described as a metal frame within a plastic frame, each independent of the other. In this regard, the metal frame is designed as a structural component which can function as a door frame independent of the outer plastic frame into which the metal frame is positioned. In turn, the outer plastic frame functions as a frame independent of the inner metal frame. By combining the metal and plastic frames into the composite metal and plastic frame structure of the present invention, there is provided a unique structure suitable for use in the manufacture of doors, windows and the like. The plastic frame, by enclosing the metal frame, provides a highly esthetic frame structure which also protects the metal frame from the elements.

Although the invention herein has been described with references to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A composite metal and plastic frame structure for windows and doors comprising a rigid self-supporting metal inner frame, a rigid self-supporting plastic outer frame having an enclosed hollow interior, said plastic outer frame having open outer edges about the outer periphery thereof and closed inner edges about the inner periphery thereof, and plastic members attached to the open outer edges of said plastic outer frame to close said open outer edges thereat, said metal inner frame contained within the enclosed hollow interior of said plastic outer frame to provide said frame structure, whereby the exterior of said metal inner frame is completely surrounded by said plastic outer frame.

2. The frame structure as set forth in claim 1, wherein said metal is aluminum and said plastic is polyvinylchloride.

3. The frame structure as set forth in claim 1, wherein said metal inner frame and said plastic outer frame each include a pair of side walls, the side walls of said metal inner frame being spaced from the side walls of said plastic outer frame to provide an opening therebetween.

4. The frame structure as set forth in claim 3, further including a plurality of ribs extending from the side walls of said plastic outer frame to maintain the space relationship between the side walls of said metal inner frame and said plastic outer frame.

5. The frame structure as set forth in claim 1, wherein said metal inner frame is constructed from a plurality of hollow metal members, and connecting means received internally within the ends of said metal members for rigidly connecting said members together.

6. The frame structure as set forth in claim 1, further including attaching means for attaching a pane to said plastic outer frame.

7. The frame structure as set forth in claim 6, further including cover means for covering said attaching means whereby said attaching means is hidden from view.

8. The frame structure as set forth in claim 1, further including hinge means for hinging said frame structure to a casing for a door, and attaching means for attaching said hinge means to said casing.

9. The frame structure as set forth in claim 8, further including cover means for covering said attaching means whereby said attaching means is hidden from view.

10. A composite metal and plastic frame structure for windows and doors comprising a metal inner frame, a plastic outer frame having a hollow interior, said plastic outer frame having open outer edges about the outer periphery thereof and closed inner edges about the inner periphery thereof, said metal inner frame contained within the hollow interior of said plastic outer frame, and plastic members attached to the open outer edges of said plastic outer frame to enclose said metal inner frame therein.

11. The frame structure as set forth in claim 10, wherein said metal is aluminum and said plastic is polyvinylchloride.

12. The frame structure as set forth in claim 10, wherein said metal inner frame and said plastic outer frame each include a pair of side walls, the side walls of said metal inner frame being spaced from the side walls of said plastic outer frame to provide an opening therebetween.

13. The frame structure as set forth in claim 12, further including a plurality of ribs extending from the side walls of said plastic outer frame to maintain the spaced relationship between the side walls of said metal inner frame and said plastic outer frame.

14. The frame structure as set forth in claim 10, wherein said metal inner frame is constructed from a plurality of hollow metal members, and connecting means received internally within the ends of said metal members for rigidly connecting said members together.

15. The frame structure as set forth in claim 10, further including attaching means for attaching a pane to said plastic outer frame.

16. The frame structure as set forth in claim 15, further including cover means for covering said attaching means whereby said attaching means is hidden from view.

17. The frame structure as set forth in claim 10, further including hinge means for hinging said frame structure to a casing for a door, and attaching means for attaching said hinge means to said casing.

18. The frame structure as set forth in claim 17, further including cover means for covering said attaching means whereby said attaching means is hidden from view.

19. A composite metal and plastic frame structure for windows and doors comprising a plurality of metal members, less than said plurality of metal members connected to form a portion of a rigid metal inner frame, a plurality of plastic members connected to form a rigid plastic outer frame having a hollow interior, said plastic outer frame including open outer edges about the outer periphery thereof and closed inner edges about the inner periphery thereof, said portion of said rigid metal inner frame contained within said hollow interior of said plastic outer frame, and connecting means for connecting the remainder of said plurality of said metal members to said portion of said rigid metal inner frame within said hollow interior of said plastic outer frame to complete said rigid metal inner frame therein.

20. The frame structure as set forth in claim 19, wherein said portion of said rigid metal inner frame has a U-shaped configuration.

21. The frame structure as set forth in claim 19, wherein said metal inner frame and said plastic outer frame each include a pair of side walls, the side walls of said metal inner frame being spaced from the side walls of said plastic outer frame to provide an opening therebetween.

22. The frame structure as set forth in claim 21, further including a plurality of ribs extending from the side walls of said plastic outer frame to maintain the space relationship between the side walls of said metal inner frame and said plastic outer frame.

23. The frame structure as set forth in claim 19, further including attaching means for attaching a pane to said plastic outer frame.

24. The frame structure as set forth in claim 23, wherein said attaching means comprises a plurality of internally threaded inserts attached to said plastic outer frame and a plurality of fasteners securable to said inserts.

25. The frame structure as set forth in claim 24, further including cover means for covering said inserts and said fasteners.

26. The frame structure as set forth in claim 19, further including hinge means for hinging said frame structure to a casing for a door, and attaching means for attaching said hinge means to said casing.

27. The frame structure as set forth in claim 26, further including cover means for covering said attaching means whereby said attaching means is hidden from view.

28. The frame structure as set forth in claim 19, further including plastic members attached to the open outer edges of said plastic outer frame to enclose said metal inner member therein.

29. The frame structure as set forth in claim 19, wherein said frame structure comprises a door or window.

30. A composite metal and plastic frame structure for windows and doors comprising a plurality of metal members, less than said plurality of metal members connected to form a portion of a rigid metal inner frame, a plurality of plastic members connected to form a rigid plastic outer frame having a hollow interior, said portion of said rigid metal inner frame contained within said hollow interior of said plastic outer frame, connecting means for connecting the remainder of said plurality of said metal members to said portion of said rigid metal inner frame within said hollow interior of said plastic outer frame to complete said rigid metal inner frame therein, a plurality of internally threaded inserts attached to said plastic outer frame, and a plurality of fasteners securable to said inserts for attaching a pane to said plastic outer frame.

31. A composite metal and plastic frame structure for windows and doors comprising a rigid self-supporting metal inner frame, a rigid self-supporting plastic outer fame having an enclosed hollow interior, said metal inner frame contained within the enclosed hollow interior of said plastic outer frame to provide said frame structure, whereby the exterior of said metal inner frame is completely surrounded by said plastic outer frame, a plurality of internally threaded inserts attached to said plastic outer frame, and a plurality of fasteners securable to said inserts for attaching a pane to said plastic outer frame.

32. A composite metal and plastic frame structure for windows and doors comprising a rigid self-supporting plastic outer frame having an enclosed hollow interior, said outer frame forming the sides, top and bottom of said windows and doors, a rigid metal inner frame constructed from a plurality of hollow metal members and connecting means for rigidly connecting said members together to provide a self-supporting inner frame separate from said outer frame, said metal members received within the enclosed hollow interior of said plastic outer frame to provide said inner frame coextensive with the sides, top and bottom of said windows or doors formed by said outer frame, whereby the exterior of said metal inner frame is completely surrounded by said plastic outer frame.

* * * * *

UNITED STATES PATENT AND TRADEMARK OFFICE

CERTIFICATE OF CORRECTION

PATENT NO. : 4,993,204

DATED : February 19, 1991

INVENTOR(S) : Kuritsky et al.

It is certified that error appears in the above-identified patent and that said Letters Patent is hereby corrected as shown below:

Column 2, line 44, after "a", insert --surrounding door opening".
Column 4, line 24, "incividual" should read --individual--.
Column 5, line 68, "emans" should read --means--.
Column 8, line 43, "member" should read --members--.

Signed and Sealed this

Twenty-ninth Day of September, 1992

*Attest:*

*Attesting Officer*

DOUGLAS B. COMER

*Acting Commissioner of Patents and Trademarks*